US006698494B1

(12) United States Patent
Hansen et al.

(10) Patent No.: US 6,698,494 B1
(45) Date of Patent: Mar. 2, 2004

(54) CASTING METHOD AND APPARATUS

(75) Inventors: Preben Nordgaard Hansen, Ålsgårde (DK); Uffe Andersen, Skævinge (DK); Laurits Aage Berg Larsen, Roskilde (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 09/889,850

(22) PCT Filed: Jan. 28, 1999

(86) PCT No.: PCT/DK99/00043

§ 371 (c)(1),
(2), (4) Date: Jul. 23, 2001

(87) PCT Pub. No.: WO00/44516

PCT Pub. Date: Aug. 3, 2000

(51) Int. Cl.[7] ..... B22D 46/00
(52) U.S. Cl. ..... 164/133; 164/457; 164/155.1
(58) Field of Search ..... 164/133, 457, 164/155.1, 130, 167

(56) References Cited

U.S. PATENT DOCUMENTS

| | | | | | |
|---|---|---|---|---|---|
| 4,585,050 | A | * | 4/1986 | Merrien et al. | 164/457 |
| 4,860,820 | A | | 8/1989 | Pereira | |
| 5,217,058 | A | | 6/1993 | Sourlier | |
| 5,735,334 | A | | 4/1998 | Sutton et al. | |
| 6,247,521 | B1 | * | 6/2001 | Kawai et al. | 164/457 |
| 6,305,460 | B1 | * | 10/2001 | Grolla | 164/119 |

* cited by examiner

*Primary Examiner*—M. Alexandra Elve
*Assistant Examiner*—Len Tran
(74) *Attorney, Agent, or Firm*—Larson & Taylor PLC

(57) ABSTRACT

The present invention relates to a method for casting ferrous or heavy metal articles in vertically parted sand moulds of a mould string plant through an inlet below or aside the mould cavity, by filling the moulds with molten metal by counter-gravity delivery using a source of pressure. The pressure is varied during the filling procedure to steer the flow speed and impact on the mould of the molten metal upon complete filling of the mould cavity is reduced.

19 Claims, 4 Drawing Sheets

CASTING METHOD AND APPARATUS

TECHNICAL FIELD

The present invention relates to a method and an apparatus for casting ferrous and heavy metal articles in vertically parted sand moulds of a mould-string plant.

BACKGROUND ART

GB-848,604 discloses a method and a casting apparatus for casting ferrous products in vertically parted moulds of e.g. green-sand moulds of a mould-string plant like the "DISAMATIC" moulding plant manufactured and marketed by the applicants. In this known method, the molten metal is supplied to the mould by pouring the molten metal from a ladle into the mould cavity. The filling operation is steered by tilting the ladle, not allowing any control over the flow speed.

In order to meet the demand for ever lighter and cast products, in particular from the automotive industry, there is an increased need for thin-walled cast ferrous products. Due to the inherently relatively thin walls, the liquid metal in the mould cools down rapidly. Therefore the thin-walled products have to be cast with a high flow speed, so that solidification of the liquid metal, before the mould cavity is completely filled, is avoided. The flow speed in the known method is regulated by tilting the ladle to a certain angle. In order to increase the flow speed the angle has to be increased. The resulting high flow speed gives the liquid metal a high inertia, i.e. the kinetic energy which increases to the power of two with the flow speed, which will, particularly with metals which have a high density, cause impact at the moment that the metal comes in contact with the walls of the mould cavity. This impact may, due to said high flow speeds, partly effect local expansions of the mould cavity causing incorrect dimensions and shapes of the resulting casting, and partly cause that the metal penetrates into the interstices between said grains in the mould wall causing the sand grains to "burn on" to the surface of the casting; and the high flow speed can cause erosion of the mould.

DISCLOSURE OF THE INVENTION

It is the object of the invention to provide an improved method and apparatus of the kind described with which said problems can be avoided or at least considerably reduced. This object is achieved with the method and the apparatus as described in detail hereinbelow.

With counter-gravity filling, by applying a variable pressure urging the liquid metal upwards into the mould and by varying that pressure, the flow speed can be controlled such that despite a high mean flow velocity the impact is eliminated or at least considerably reduced.

The pressure may be delivered by a pump supplying a gas to a sealed container with molten metal. The pressure urging the molten metal to the mould may, however, also be imparted by a pump, which acts directly on the molten metal.

The metals used with the present invention include iron, steel, copper, lead and alloys thereof.

According to an embodiment of the invention, the flow speed is steered to follow a predetermined value as a function of time.

According to another embodiment of the invention, the reservoir of molten metal is placed below the mould, or at the side of the mould, such that the upper level of molten metal in the reservoir is below the mould cavity.

According to yet another embodiment, the filling process is closed-loop controlled.

According to a further embodiment, the molten metal is delivered by pressurising a sealed container containing the molten metal.

According to another embodiment the moulds are provided with a closure means.

DESCRIPTION OF THE PREFERRED EMBODIMENT

Figure 1:
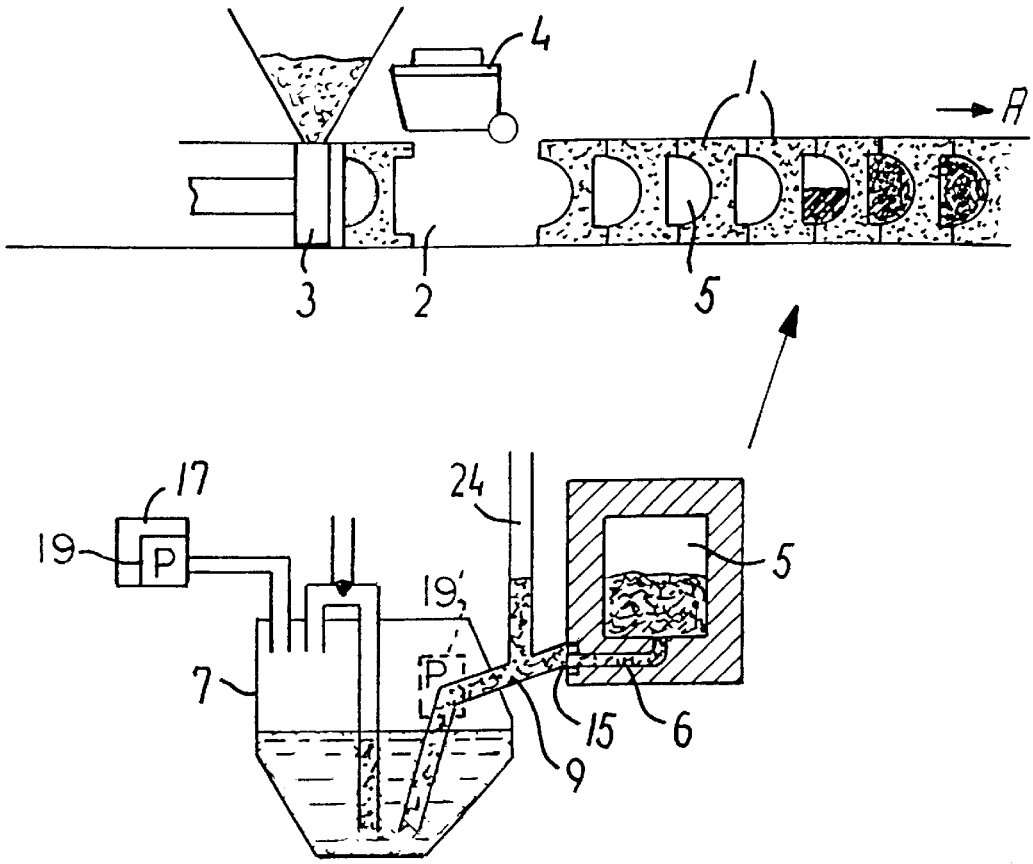
FIG. 1 shows a diagrammatic side view of an embodiment of a casting apparatus in accordance with the invention.

Referring now to the drawings, the apparatus illustrated in particular in FIG. 1 comprises a combined mould-making and casting apparatus, e.g. of the DISAMATIC® type. This apparatus as such is dealt with GB-848,604 which describes the mode of operation, and for this reason it is only dealt with broadly in this specification.

Box-less mould parts 1 made from loose green-sand, i.e. sand with moist clay as binder, supplied from a hopper to a moulding chamber 2 defined between a pattern located on a movable piston 3 and a pattern located on a movable and upwardly pivotable counter-pressure plate 4 in a downwardly pivoted position (not shown) of the counter-pressure plate 4. In the moulding chamber 2, the green-sand is compacted by the piston 3 to form a mould part, the counter-pressure plate 4 is conveyed forward and pivoted upwards to the position shown in FIG. 1, after which the mould part is conveyed by the piston 3 to abut against the mould string formed by previously produced mould parts 1, said mould string being conveyed over a distance corresponding to the thickness of a mould part 1 in the direction indicated by an arrow A. In the mould string, the front side of a mould part 1 together with the rear side of the previous mould part 1 defines a mould cavity 5 being cast with a ferrous or heavy metal through an inlet 15 of a runner 6, which may be on a side or bottom wall of the mould below the level of the mould cavity and situated in or at the parting surface between two mould parts, by means of a casting device.

It will be appreciated that the casting of the mould cavity must take place while the mould string is stationary, i.e. within the intervals between each time the piston 3 advances the mould string through a distance corresponding to the thickness of a mould part 1 in the direction of the arrow A.

The casting apparatus comprises a heated and sealed reservoir for the molten metal and comprises in short the following operational components:

- a supply of molten metal contained in a substantially closed furnace 7
- a gas-supply unit 17 adapted to apply a suitably controlled gas pressure to the space inside the furnace so as to cause molten metal to flow out
- a filling tube 9 extending upwardly to a mouthpiece 10 adapted for temporary connection to the mould being in a position for filling, and a shutter mechanism to close the inlet after filling the mould to enable forward transportation of the mould string before the inlet freezes naturally.

In addition to the operational components listed above, the casting apparatus comprises various sensing and control components (FIG. 3), viz.

a delivery pressure sensor 12 or sensor arrangement adapted to measure the pressure of the gas-supply unit 17, a first pressure sensor 27 adapted to sense the pressure inside the furnace, a second pressure sensor 13 adapted to measure the pressure in the filling tube, a melt-level sensor 14 adapted for sensing the pressure or absence of melt in the filling tube at a level lower than that of the mouthpiece 10, a lower filling sensor 11 adapted for sensing the pressure or absence of melt in the mouthpiece immediately upstream of its connection to the mould, and a main control unit 26 adapted to receive and process signals from the sensors, and on the basis of such processed signals, to send a control signal to the gas-supply unit 17.

At this point it should be emphasized that the sensors need not always all be in operation in each and every mould filling process, the choice of which of them to use being based upon circumstances in each particular case.

The lower part of FIG. 1 shows the mould 1 at the mould filling station in section on the vertical parting line. The mould is shown part-filled with metal, the remainder of the mould cavity 5 being empty. The metal enters the mould through a filling tube 9 leading the molten metal from the furnace 7 to the inlet 15 of the mould.

For filling the mould the inlet 15 is temporarily connected with the mouthpiece 10 at the upper end of the filling tube 9. The heated inlet tube 9 is submerged at its lower end in the molten metal contained in the closed furnace 7. The filling tube extends upwards from the bottom region of the furnace 7. The furnace 7 is adapted to supply molten metal from a mass of molten metal resting in the bottom region of a closed chamber 16 within the furnace 7 by, through the use of gas pressure from a gas-supply unit 17 through a gas-supply conduit 18, forcing molten metal upwardly against the effect of gravity through the filling tube 9 to a mouthpiece 10 adapted for temporary connection to the inlet 15 of the mould which leads to the filling conduit or runner 6 of a mould. The delivery of the molten metal is "upwards", i.e. counter gravity, but this does not exclude the possibility that a part of the path that the molten metal follows is downwards, for example in the runner. Branched from the upper end of the filling tube 9 there may also be an external riser 24 that can be used to influence the filling of the mould.

The optional external riser 24 acts as a "pressure buffer" preventing both too high and too low filling rates.

The filling tube 9, with the mouthpiece 10 as well as the external riser 24 are, of course, suitably heated and/or thermally insulated to keep the metal in them in the molten state.

The pressure in the closed chamber is controlled with an arrangement 20, 21, 22, 23. This arrangement comprises a sensing tube 20 extending from a location close to the bottom of the closed chamber 16 to outside of this chamber, terminating in a three-way valve 21 with two positions. To this valve are further connected a pressure-equalisation tube 22 and a vent tube 23, the valve 21 being so arranged that it either connects the sensing tube 20 to the vent tube 23 and a position, in which it connects the sensing tube 20 to the pressure-equalisation tube 22.

A second melt level sensor 25 is placed in the sensing tube 20 at such a level that when the level in the sensing tube rises to a level the same or just below the level of the mouthpiece 10, the sensor reacts and sends a signal to the main control unit 26, preferably being in the form of a PLC or a digital computer of the type used for controlling industrial processes, adapted to control the operation of the apparatus including the gas-supply unit 17, the advancing of the mould string and other functions easily conceived by the skilled person, such as melt temperature control, flow speed control etc.

Figure 2:
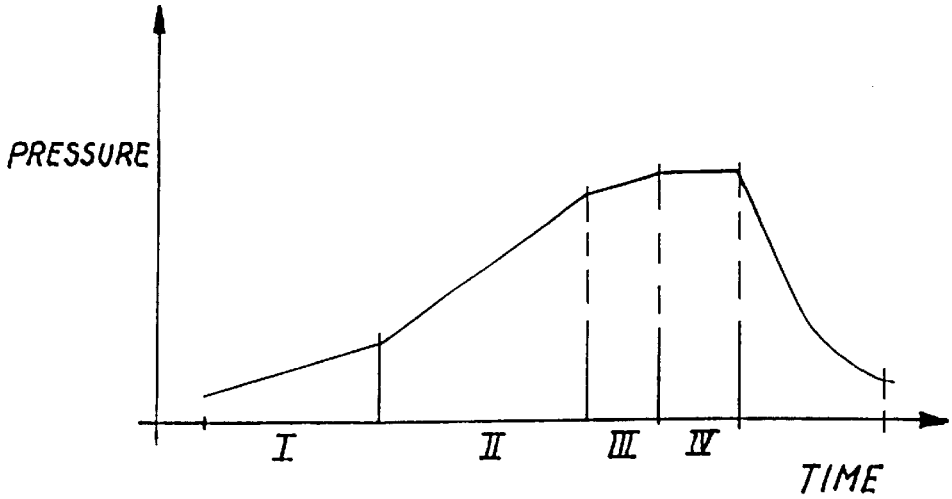
FIG. 2 is a graph of a mould filling profile.

The gas-supply unit 17 may comprise a pump 19 (shown only in FIG. 1 for clarity), or alternatively the pressure urging the molten metal to the mould may be imparted by a pump 19' which acts directly on the molten metal (as shown schematically in FIG. 1). Gas unit 17 can be controlled by the main control unit 26 to vary the pressure in the closed chamber 16 and thereby control the flow speed of the molten metal towards and into the mould cavity 5. The pump 19 can be controlled by the main control unit in response to the supply pressure sensor 12. The control of the pressure in the closed chamber 16 acting on the molten metal is controlled in accordance with a predetermined value as a function of time. An example of such function is shown in FIG. 2. The profile of the moulding function is chosen such as to achieve optimum filling conditions, e.g. first filling the major part of the casting cavity 5 at relatively high pressure, but not so high as to cause undue turbulence, and then reducing the pressure to achieve a gentle and chockfree filling of the top of the casting cavity. The programme installed in the main control unit 26 could be divided into five steps, cf. FIG. 2:

I: Pre-filling pressure: Mould being prepared for filling.

II: Filling pressure: Programme to fill the mould to a level slightly below the top as quickly as possible while avoiding turbulence and oscillations.

III: Holding pressure: Increasing slowly to avoid melt impact to the top of the casting cavity.

IV: Closing pressure: Held constant while the mould is being closed.

V: Relaxation pressure: Adjusted for non-turbulent return flow of melt from the upper part of the filling tube to the furnace.

These pressures are preferably those measured by the pressure sensors 27 and/or 13 and signalled to the main control unit 26. The control of the pressure in the closed chamber 16 in response to these measured pressures is according to a preferred embodiment of the closed-loop type. The main control unit 26 is then integrated in the control loop and may be used for carrying out a variety of different control functions, such as proportional, integral and differential closed-loop feedback.

The filling of the mould 1 takes place at a mould filling station, which mould 1 in the the string of moulds passes sequentially. When an empty mould has arrived at the filling station by movement of the mould string in the direction of the arrow A, the inlet 15 of the mould is temporarily connected to a mouthpiece 10 at the upper end of the filling tube 9. Hereto the mouthpiece 10 is advanced towards the mould until it registers with the inlet 15.

Figure 3:
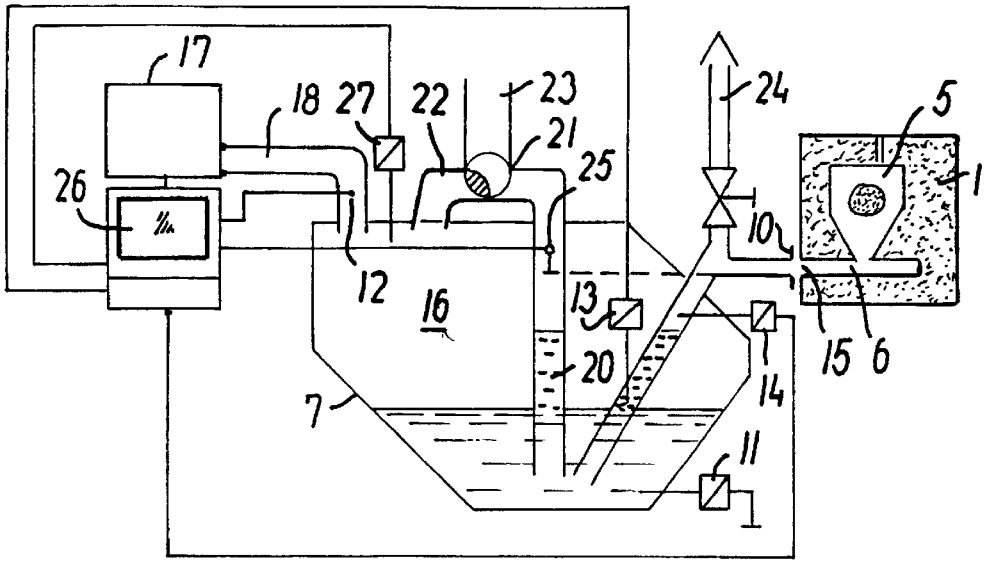
FIGS. 3–5 are diagrammatic views in cross-section, showing the apparatus in various stages.
Figure 4:
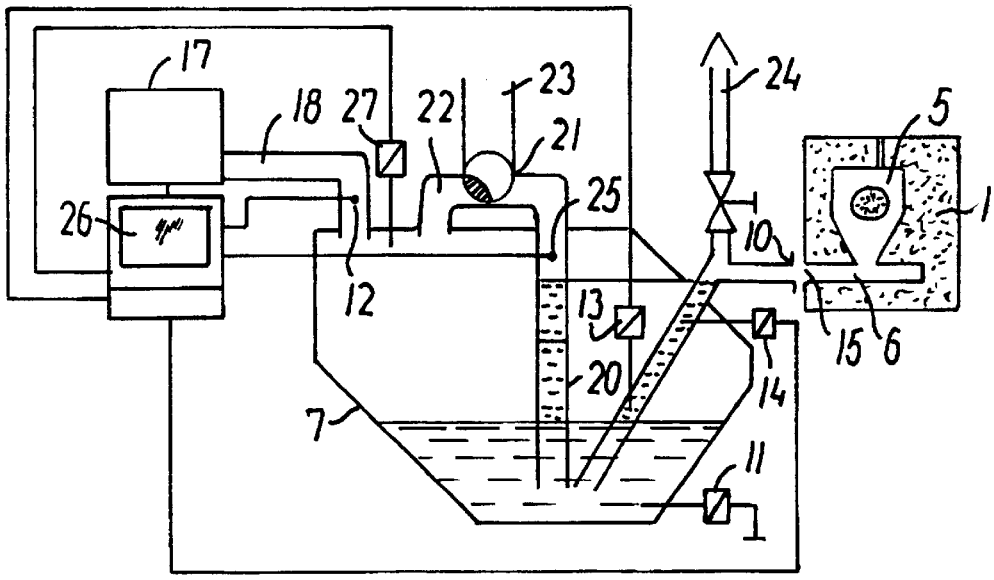

Prior to the process of filling each mould an operation of establishing a reference level of metal in the filling tube with a view to achieving identical starting points for the filling of all moulds, is carried out. In FIG. 3 the three-way valve 21 is in its first position, in which it connects the sensing tube 20 to the vent tube 23 and thus to atmosphere. A fresh mould 1 has just been placed with its runner 6 connected to the mouthpiece 10. The level of the molten metal is the same in the sensing tube 20 and in the filling tube 9, but higher than in the closed chamber 16 due to a moderate gas pressure being supplied by the gas-supply unit 17. With the valve 21 in the position shown in FIG. 4, gas pressure in the gas supply conduit 18 is now increased, causing the molten metal to rise in the sensing tube 20 as well as in the filling tube 9. As shown in FIG. 4, the rising metal column in the sensing tube activates the second level sensor 25 to send a signal to the main control unit 26, the latter at this instant recording the pressure in the closed chamber 16 as sent by the pressure sensor 27, making a note of this pressure as a datum pressure, at which the metal column in the sensing tube 20 just touches the second level sensor 25. A datum pressure corresponding to a datum level at which the metal column in the sensing tube 20 just touches the level sensor 25, having now been recorded by the main control unit 26, the next step shown in FIG. 5 can now be carried out.

Figure 5:
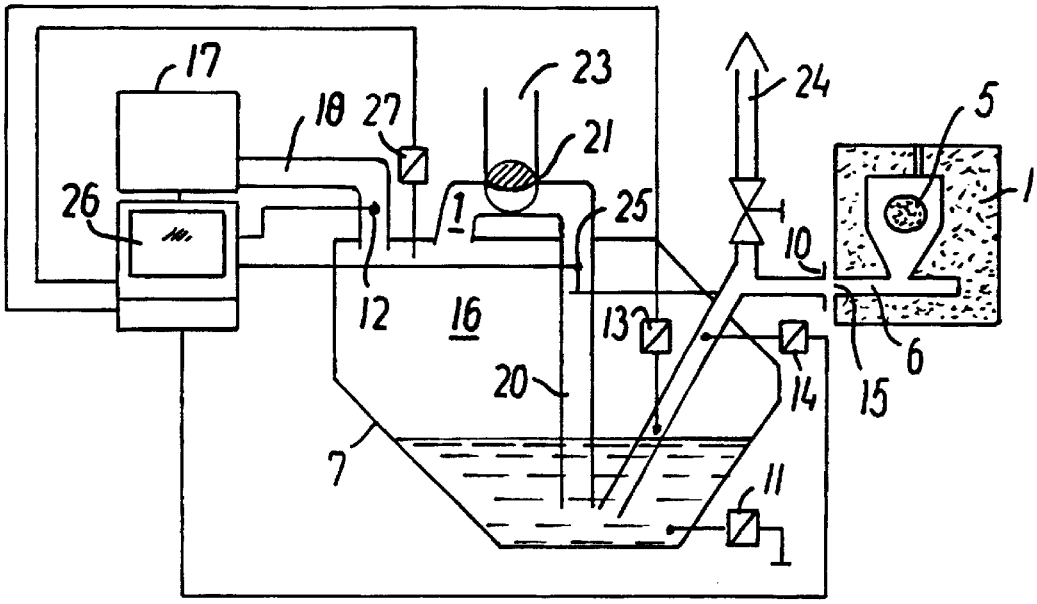

In the situation shown in FIG. 5, the three-way valve 21 is in its second position, in which it connects the sensing tube 20 to the pressure-equalisation tube 22, so that there is no longer any pressure differential to hold a column of metal up against the second level sensor 25. The level of metal in the filling tube 9 is, however, the same as shown in FIG. 4, because the upper end of the filling tube 9 is still connected to the atmosphere through the external riser 24. According to the invention the level of metal in the filling tube 9 is maintained at this level by suitably controlling the gas-supply unit 17 to maintain the pressure in the closed chamber 16 at the previously recorded datum value established in the step shown in FIG. 4 and described above.

It is important at this stage to note that the level of metal in the filling tube 9 will be at the datum level, regardless of whether the furnace 7 contains a smaller or larger amount of molten metal.

The filling procedure described up to now corresponds to step 1 of the mould-filling profile as shown in FIG. 2 described above.

In the next step shown in FIG. 1, which corresponds to step II of the mould-filling profile, the pressure in the closed chamber 16 is increased by supplying additional gas through the supply unit 17, so as to force the molten metal in the filling tube 9 to flow upwards, partially to and through the mouthpiece 10 into the mould through the latter's runner 6, partially up into the external riser 24 to a filling level, that may or may not be monitored by a further level sensor (not shown), e.g. of the same kind as the second level sensor 25.

The process of filling the mould 1 is controlled in a pre-programmed manner according to the mould filling profile stored in the main control unit 26. After finishing the filling step II, the filling procedure continues with filling step III in which the pressure in increased slowly to avoid melt impact to the top of the mould cavity 5, the corresponding step being stored in the main control unit 26 and preferably being carried out under a closed-loop control according to input from the before-mentioned sensor arrangement. The exact mould-filling profile to be followed does not form part of the invention, and will, of course, be adapted to the particular conditions of each run of casting operations, such as shape and size of the mould cavity 5, the characteristics of the casting metal etc.

After preventing backflow from the molten metal in the mould cavity 5, by closure means described hereinafter, the pressure in the closed chamber 16 can be reduced down to a value corresponding to the situation shown in FIG. 5 or further. The mouthpiece 10 is retracted from the inlet 15 and the mould can be transported forward in the direction of the arrow A.

Figure 6:
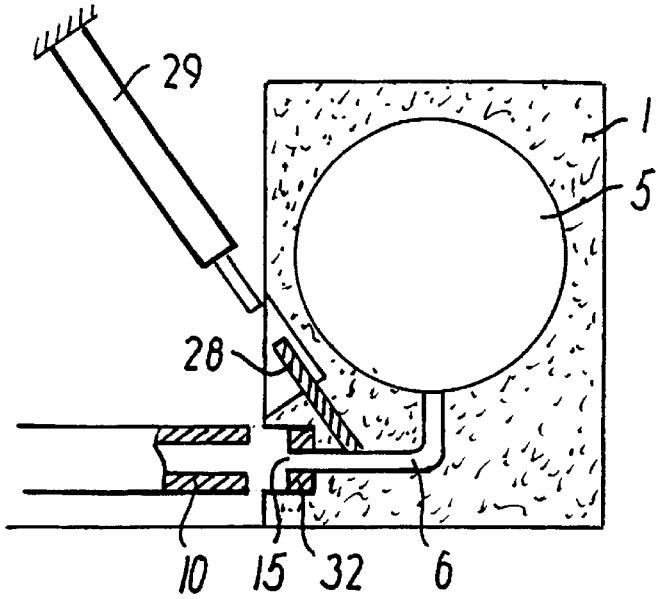
FIGS. 6–7 show cross-sectional views of the mould focussing on the closing means and the sealing element.
Figure 7:
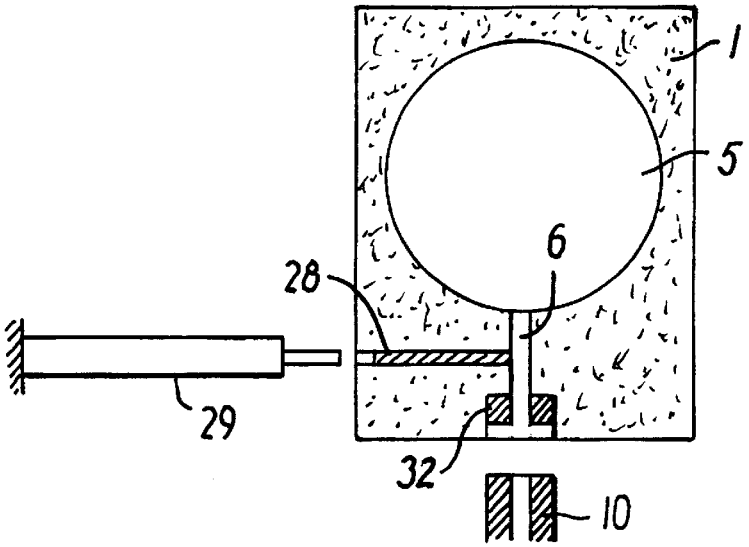

Since the mould string is transported before the molten metal in the inlet 15 of the mould has completely solidified, closure means are provided which prevent backflow of the molten metal. The closure means (FIGS. 6, 7, 8) comprise a movable element 28 which may be composed of any material capable of resisting the temperature influence and the erosion from the cast metal, e.g. of cured core sand, ceramic material or metal.

The movable closure element 28 is placed in a recess of suitable dimensions disposed in at least one of the mould parting surfaces. It is gripped between the mould parts in such a manner that frictional force has to be overcome in order to displace the movable closure element inwardly into the mould. The movable closure element 28 is guided in the recess in such a manner that it can carry out a translating movement towards and through the runner 6 to thereby close the mould and prevent molten metal from flowing back. An actuator 29 is provided for moving the movable element 28 from its open position into its closed position just after the mould has been filled. The actuator 29 pushes the movable element into the mould. The movable element is guided in the recess along a trajectory that crosses the runner 6. By intersecting the runner 6 the movable element closes the mould.

Figure 8:
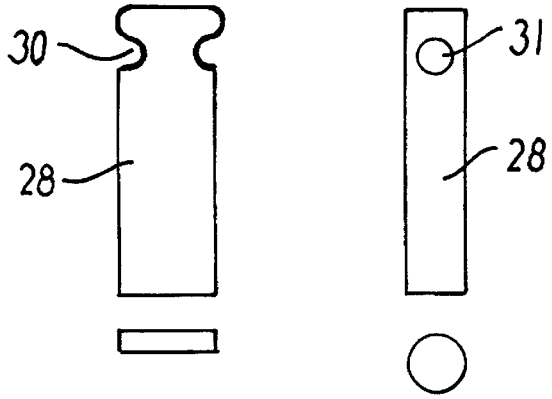
FIG. 8 shows in detail the movable closure element.

The movable element can take different shapes as can be seen from FIG. 8, e.g. it may have the shape of an rectangular plate or it may have the shape of a cylindrical rod. The closure element 28 has preferably an elongated shape with its front end directed towards the runner, and the opposite rear end being provided with means for catching the movable closure element in the form of incisions 30, or through holes 31. The catching means are provided for allowing removal of the movable closure element from the mould for reuse before the mould is destroyed.

According to another embodiment at the inlet 15 of the mould there is provided a resilient sealing element 32. The element is arranged around the external opening of the mould, i.e. the inlet 15, and is made of heat-resistant and heat-insulating material capable of forming a liquid-tight seal between the mould and the mouthpiece 10 of the filling tube.

Figure 9:
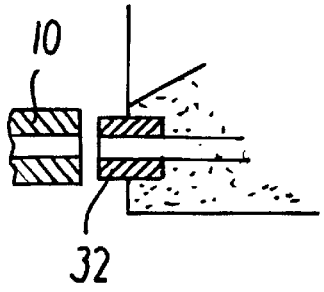
FIG. 9 shows a detail in cross-section of the sealing member and the mouthpiece.

The sealing element 32 (FIG. 9) is preferably made of a material providing the best possible seal with the mouthpiece 10. A sealing ring 32 made from ferrous or ceramic material, e.g. aluminium oxide or silicon oxide, has proved useful, but other materials are, of course, possible. The sealing ring 32 not only provides a liquid-tight seal, but also prevents direct contact between the mould 1 and the mouthpiece 10, thus avoiding contamination of the latter with particles of sand that can easily come loose from the mould. Further, because of its resilient properties the sealing ring 32 is also capable of accommodating minor variations in the relative positions of the runner due to flexure of the runner and the mouthpiece 10 bearing in mind that the latter will have to cooperate with a great number of moulds passing through the filling station. Still further, because of its heat-insulating properties, the sealing ring 32 prevents molten metal from solidifying in contact with the mouthpiece 10—otherwise this could disturb the engagement of the latter with the sealing ring on the next mould.

It will be appreciated that numerous modifications may be made without departing from the scope of the invention as defined in the appending claims. For example the closure element can be formed by the sand of the mould itself which is pushed into the runner in order to close the mould. In this embodiment (not shown), there will be a filter placed in the runner to avoid sand flowing back with the molten metal into the reservoir.

| List of reference numerals | |
|---|---|
| 1 | Mould part |
| 2 | Moulding chamber |
| 3 | Piston |
| 4 | Counter-pressure plate |
| 5 | Mould cavity |
| 6 | Runner |
| 7 | Furnace or reservoir |
| 9 | Filling tube |
| 10 | Mouthpiece |
| 11 | Lower filling sensor |
| 12 | Delivery pressure sensor |
| 13 | Second pressure sensor |
| 14 | Melt level sensor |
| 15 | Inlet |
| 16 | Closed chamber |
| 17 | Gas-supply unit |
| 18 | Gas-supply conduit |
| 20 | Sensing tube |
| 21 | Three-way valve |
| 22 | Pressure equalisation tube |
| 23 | Vent tube |
| 24 | External riser |
| 25 | Second melt level sensor |
| 26 | Main control unit |
| 27 | First pressure sensor |
| 28 | Movable element |
| 29 | Actuator |
| 30 | Incision |
| 31 | Through hole |
| 32 | Sealing element |

What is claimed is:

1. Method for casting ferrous or heavy metal thin-walled articles in vertically parted sand moulds of a mould-string plant where each mould includes a mould cavity having a top, said method comprising the steps of:

providing a reservoir containing molten metal to be delivered to the moulds; and filling the moulds with molten metal through counter-gravity delivery, said filling step including for each mould the steps of applying a variable pressure to the molten metal delivered to the mould, and varying the applied variable pressure during the filling of the mould cavity to thereby control a flow speed of the molten metal in the mould cavity, said applying step including the steps of (a) filling a major part of the mould cavity, up to an upper level below the top of the mould cavity, initially at a high flow speed which is high enough to prevent solidification of thin walls of the article but which is low enough to avoid undue turbulence in the mould cavity, and (b) filling of a remainder of the mould cavity from the upper level to the top of the mould at a low flow speed which is lower than the high flow speed and which achieves a gentle and chockfree filling at the top of the mould, and maintaining a backflow preventing pressure on the mould cavity after filling to the top of the cavity has taken place.

2. Method according to claim 1, wherein the filling a major part of the mould cavity step includes varying the pressure to cause the resulting high flow speed to commence at a first high flow speed and then to gradually increase to a pre-set maximum high flow speed.

3. Method according to claim 1, wherein the filling of a remainder of the mould cavity step includes varying the pressure to cause the resulting low flow speed to gradually decrease as the top of the mould is completely filled.

4. Method according to claim 1, wherein the filling steps associated respectively with the high and low flow speeds are controlled to follow a predetermined value as a function of time.

5. Method according to claim 1, wherein the pressure varying step varies the pressure in response to a signal of a closed-loop control system.

6. Method according to claim 5, wherein an input for the closed-loop control used in the pressure varying step is derived from one of the following parameters:

a pressure in a delivery conduit, a pressure in the reservoir, a level of said molten metal in the reservoir, a power supplied to provide the pressure to the molten metal, and a decrease in weight per unit time of said furnace.

7. Method according to claim 1, wherein the molten metal is delivered to the mould from the reservoir which is provided below or sideways to the mould.

8. Method according to claim 1, wherein the provided reservoir is sealed.

9. Method according to claim 1, further including the step of producing the moulds from identical mould-halves which define on a first side a part of a first mould cavity and on a second and opposite side a part of a second mould cavity.

10. Method according to claim 1, wherein the pressure applying step includes providing a source of pressure with a pump.

11. Method according to claim 10, wherein the pump delivers a gas under pressure to the reservoir to thereby pressurize one of the reservoir or a sealed chamber within the reservoir.

12. Method according to claim 1, further including the step of actuating a closure means for closing an inlet of the mould.

13. Method according to claim 12, wherein the closure means comprises a movable closure element placed in a recess disposed in at least one mould parting surface.

14. Method according to claim 13, wherein the movable closure element has an elongated body with a front end directed to a runner of the mould, and an opposite end is provided with means for catching the closure element for easy removal from the mould.

15. Method according to claim 12, wherein the step of actuating the closure means occurs automatically when the moulds in a mould string are advanced in the mould string plant.

16. Method according to claim 13, wherein the closure means further comprises an actuator for moving the closure element to its closed position.

17. Method according to claim 1, further including the step of advancing the moulds of a mould string together after a single mould has been filled in order to place a next mould at a filling location.

18. Method according to claim 17, wherein said advancing step advances the moulds before complete solidification of the metal occurs in an inlet to the mould.

19. Method according to claim 1, further including the step of providing a resilient sealing member which surrounds an inlet of the mould and which provides for sealing engagement with a mouthpiece of a filling tube.

* * * * *